US008272334B2

(12) United States Patent
Wang et al.

(10) Patent No.: US 8,272,334 B2
(45) Date of Patent: Sep. 25, 2012

(54) THREE-LINK TOGGLE TYPE POSITIONING PLATFORM

(75) Inventors: Sheng-Wei Wang, Tao-Yuan (TW); Kuen-An Hsie, Tao-Yuan (TW); Liang-Zheng Huang, Tao-Yuan (TW); Shih-Ming Wang, Tao-Yuan (TW)

(73) Assignee: Chung Yuan Christian University, Tao-Yuan (TW)

( * ) Notice: Subject to any disclaimer, the term of this patent is extended or adjusted under 35 U.S.C. 154(b) by 0 days.

(21) Appl. No.: 12/774,281

(22) Filed: May 5, 2010

(65) Prior Publication Data

US 2012/0006140 A1 Jan. 12, 2012

(30) Foreign Application Priority Data

May 5, 2009 (TW) ..... 98114892 A

(51) Int. Cl.
*A47B 85/00* (2006.01)

(52) U.S. Cl. ..... 108/20; 108/143

(58) Field of Classification Search ..... 108/20, 108/21, 22, 140, 143, 137, 145, 102; 74/490.09, 74/490.03
See application file for complete search history.

(56) References Cited

U.S. PATENT DOCUMENTS

| | | | | | |
|---|---|---|---|---|---|
| 4,972,574 | A | * | 11/1990 | Isono et al. | 74/479.01 |
| 5,378,282 | A | * | 1/1995 | Pollard | 74/490.06 |
| 5,421,695 | A | * | 6/1995 | Kimura | 74/490.03 |
| 5,477,743 | A | * | 12/1995 | Yanagisawa | 74/490.09 |
| 5,481,936 | A | * | 1/1996 | Yanagisawa | 108/139 |
| 5,613,403 | A | * | 3/1997 | Takei | 74/490.09 |
| 5,903,125 | A | * | 5/1999 | Prentice et al. | 414/744.4 |
| 6,157,157 | A | * | 12/2000 | Prentice et al. | 414/744.4 |
| 6,276,284 | B1 | * | 8/2001 | Remley et al. | 108/20 |
| 6,328,510 | B1 | * | 12/2001 | Hanrath et al. | 74/490.1 |
| 6,705,177 | B2 | * | 3/2004 | Okuno et al. | 74/490.01 |
| 7,100,515 | B2 | * | 9/2006 | Helm et al. | 108/20 |
| 7,152,331 | B2 | * | 12/2006 | Nakamura et al. | 33/1 M |

FOREIGN PATENT DOCUMENTS

| | | | |
|---|---|---|---|
| JP | 05346149 | A * | 12/1993 |
| JP | 05346150 | A * | 12/1993 |

* cited by examiner

*Primary Examiner* — Jose V Chen
(74) *Attorney, Agent, or Firm* — WPAT., P.C.; Justin King

(57) ABSTRACT

A three-link toggle type positioning platform comprises a first motor, a first ballscrew coupled to said first motor, a first linkage attached to the ballscrew a second linkage attached to the first linkage, and a third linkage attached to the second linkage. The ballscrew drives the first linkage, and then the first linkage drives the second linkage, and then the second linkage drives the third linkage, which drives a platform in a predetermined direction.

26 Claims, 8 Drawing Sheets

| Number of motor turns (integral turns) | Moving distance (mm) | Number of motor turns (integral turns) | Moving distance (mm) |
|---|---|---|---|
| 5 | 0.7812 | 30 | 7.6705 |
| 6 | 1.0139 | 31 | 7.8445 |
| 7 | 1.2816 | 32 | 8.0185 |
| 8 | 1.6048 | 33 | 8.2125 |
| 9 | 1.9097 | 34 | 8.4111 |
| 10 | 2.248 | 35 | 8.6134 |
| 11 | 2.567 | 36 | 8.8057 |
| 12 | 2.8804 | 37 | 9.0515 |
| 13 | 3.184 | 38 | 9.1801 |
| 14 | 3.4766 | 39 | 9.3666 |
| 15 | 3.7824 | 40 | 9.572 |
| 16 | 4.068 | 41 | 9.7327 |
| 17 | 4.3407 | 42 | 9.9602 |
| 18 | 4.6105 | 43 | 10.1136 |
| 19 | 4.8948 | 44 | 10.2575 |
| 20 | 5.1673 | 45 | 10.391 |
| 21 | 5.5175 | 46 | 10.5237 |
| 22 | 5.7415 | 47 | 10.6836 |
| 23 | 6.005 | 48 | 10.843 |
| 24 | 6.1967 | 49 | 11.0055 |
| 25 | 6.4415 | 50 | 11.1553 |
| 26 | 6.6831 | | |
| 27 | 6.916 | | |
| 28 | 7.1471 | | |
| 29 | 7.4403 | | |

FIG. 7

THREE-LINK TOGGLE TYPE POSITIONING PLATFORM

BACKGROUND OF THE INVENTION

1. Field of the Invention

The present invention relates to a positioning platform and machine tool, and more particularly to a three-link toggle type positioning platform and machine tool.

2. Description of the Related Art

Machines establish the groundwork of manufacturing industry, due to all products are produced by machines. Furthermore, machine tools establish the groundwork of mechanical industry due to all manufacturing processes require machine tool. Therefore, with the development in industry and the advancement in technology, the machine tool industry will be progressed as well. Because bio-medical industry, telecommunication industry and optoelectronical industry ramp recently, current related products have developed to be more miniaturized, for example, micro optical components of high-speed signal transmission, micro-sensors, micro holes of optical fibers and photolithography. Accordingly, the micro/meso-scale manufacturing technology is the key point in the oncoming fabrication technology.

In industrial applications, precise machining is based on high precision positioning technology. Therefore, how to enhance precise positioning is an important index in promotion of industry. The difficulties of the precise positioning technology resulted from too many uncertain factors. Generally, the factors, which are not concerned in large-scale positioning, should be concerned in micro/nano scale positioning.

The wet etching, plasma etching, LIGA process, electron beam, ion beams and so on are used in nano-scaled machining, thus resulting in the development of micro-electro mechanical system (MEMS). Generally speaking, MEMS technology is applied in the fabrication of about 2D to 2.5D geometry, and the relative precision of fabrication is limited to about $10^{-1}$ to $10^{-2}$ millimeter. However, for many 3-D miniaturized products having requirements of higher precision and complex shape, the MEMS technology is not able to meet the requirements. Besides, another bottleneck of the MEMS technology is that it can not be applied to metallic material or other diversified materials. Furthermore, scanning tunneling microscope (STM) or atomic force microscope need to be used in nano-scaled fabrication, but the operation speed is lower and the technique is not mature yet.

Currently, machine tools of multi-axles are serial connected mechanism. This serial connected mechanism, which is similar to cantilever beams, has a larger working area, but it may deform or have displacement due to external loading or its weight. Therefore, only the conventional servo system of serial connected mechanism of higher precision may achieve the precision of sub-micron or even nano-meter scaled. However, the requirements of the related control technique are very strict, and the cost of the whole equipment is effectively increased. Besides, machines features the piezoelectric actuators also have the problems of smaller stroke and hysteresis.

Generally, platforms of meso-scale machine tools, such as milling machines, are being directly placed on ballscrews and then driven by motors to move. Intrinsic or extrinsic vibration will affect machine tools operation and precision at the same time. Refer to FIG. 1, FIG. 1 shows a Taiwanese patent publication No. 302862, which discloses a toggle-type positioning platform, as a prior art. A screw rod 64 connects with a second platform 14 by a linkage 62, wherein the moving direction of the second platform 14 is perpendicular to the screw rod 64. When the screw rod 64 driven by a motor 46 to rotate, the linkage 62 and the second platform 14 start to move along a predetermined path 54. To overcome the aforesaid disadvantages, the linkage 62 being disposed between the screw rod 64 and the second platform 14. Since the length L of the linkage 62 is fixed and the displacement of one end of the linkage 62 on the screw rod 64 is known, therefore the perpendicular distance H from the connecting portion to the screw rod 64 can be calculated from the trigonometric and geometric relationship. According to the numerical analysis data of the prior art, when the displacement of the screw is very small, the smaller distance H and higher positioning precision ΔH may be attained. Therefore, the length of the linkage, the displacement of the screw rod, the angle between the linkage and screw rod and other factors may affect the resolution and sensitivity of the platform. The method described above may provide higher precision of the machine tool, but the move speed of the platform is relatively low. Therefore, the present invention discloses a three-link toggle type apparatus to overcome the aforesaid disadvantages. Moreover, by the calculation of trigonometric functions, the precision of the platform can be less affected by extrinsic force and vibration and, at the same time, increase the move speed of the platform.

SUMMARY OF THE INVENTION

To achieve the aforesaid object and industrial demands, the present invention discloses a three-link toggle type positioning platform which comprises a first platform, a first motor, a first ballscrew, a second platform, a first linkage, a second linkage and a third linkage. The first motor is disposed on the first platform. The first ballscrew is disposed on the first platform and coupled to the first motor, wherein the first motor is suitable for driving the first ballscrew to rotate. The second platform is disposed on the first platform, wherein the second platform is suitable for moving back and fourth alternately along a first predetermined path, wherein a first angle is existed between an extended direction of the first predetermined path and the first ballscrew. The second linkage is fixed on a first base, and is parallel to the first ballscrew and the second platform. The first linkage is disposed between the first ballscrew and the second linkage for connection, wherein a second angle is existed between the first ballscrew and the first linkage. The third linkage is disposed between the second linkage and the second platform, wherein a third angle is existed between the second linkage and the third linkage. Moreover, the first linkage, the second linkage and the third linkage are driven simultaneously by the rotation of the first ballscrew, such that the second platform is driven to move along the first predetermined path.

According to the present invention, the first angle of the three-link toggle type positioning platform is about 90°.

According to the present invention, the second angle of the three-link toggle type positioning platform is between about 0° to 90°.

According to the present invention, the third angle of the three-link toggle type positioning platform is between about 0° to 90°.

According to the present invention, the three-link toggle type positioning platform comprises two first linear bearings penetrate a first slide rail respectively, wherein the two first linear bearings are disposed on bilateral sides of the second platform and between the second platform and the first platform.

According to the present invention, the two first linear bearings of the three-link toggle type positioning platform are perpendicular to the first ballscrew.

According to the present invention, the two opposite ends of the first linkage of the three-link toggle type positioning platform are connected to the first ballscrew and the second linkage by a ball bearing and a bolt.

According to the present invention, the two opposite ends of the second linkage of the three-link toggle type positioning platform are connected to the first linkage and the first base by the ball bearing and the bolt.

The present invention further provides a three-link toggle type machine tool which comprises a first three-link toggle type positioning platform and a second three-link toggle type positioning platform. The first three-link toggle type positioning platform comprises a first platform, a first motor, a first ballscrew, a second platform, a first linkage, a second linkage, and a third linkage. The first motor is disposed on the first platform. The first ballscrew is disposed on the first platform and coupled to the first motor, wherein the first motor is suitable for driving the first ballscrew to rotate. The second platform is disposed on the first platform, wherein the second platform is suitable for moving back and fourth alternately along a first predetermined path, wherein a first angle is existed between an extended direction of the first predetermined path and the first ballscrew. The second linkage is fixed on a first base, wherein the second linkage is parallel to the first ballscrew and the second platform. The first linkage is disposed between the first ballscrew and the second linkage, wherein a second angle is existed between the first balscrew and the firstlinkage. The third linkage is disposed between the second linkage and the second platform, wherein a third angle is existed between the second linkage and the third linkage. Moreover, the first linkage, the second linkage and the third linkage are driven simultaneously by the rotation of the first ballscrew, such that the second platform is driven to move along the first predetermined path.

The second three-link toggle type positioning platform is disposed on the first three-link toggle type positioning platform, wherein the second three-link toggle type positioning platform comprises a second motor, a second ballscrew, a third platform, a fourth linkage, a fifth linkage, and a sixth linkage. The second motor is disposed on the second platform. The second ballscrew is disposed on the second platform and coupled to a second motor, wherein the second motor is suitable for driving the second ballscrew to rotate. The third platform is disposed on the second platform, wherein the third platform is suitable for moving back and fourth alternately along a second predetermined path, wherein a fourth angle is existed between an extended direction of the second predetermined path and the second ballscrew. The fourth linkage is disposed between the second ballscrew and the fifth linkage, wherein a fifth angle is existed between the second ballscrew and the fourth linkage. The fifth linkage is fixed on a second base, and is parallel to the second ballscrew and the third platform. The sixth linkage is disposed between the fifth linkage and the third platform, wherein a sixth angle is existed between the fifth linkage and the sixth linkage. Moreover, the fourth linkage, the fifth linkage and the sixth linkage are driven simultaneously by the rotation of the second ballscrew, such that the third platform is driven to move along the second predetermined path.

According to the present invention, the first angle of the three-link toggle type machine tool is about 90°.

According to the present invention, the second angle of the three-link toggle type machine tool is between about 0° to 90°.

According to the present invention, the third angle of the three-link toggle type machine tool is between about 0° to 90°.

According to the present invention, the fourth angle of the three-link toggle type machine tool is about 90°.

According to the present invention, the fifth angle of the three-link toggle type machine tool is between about 0° to 90°.

According to the present invention, the sixth angle of the three-link toggle type machine tool is between about 0° to 90°.

According to the present invention, the three-link toggle type machine tool further comprises two first linear bearings penetrate a first slide rail respectively, wherein the two first linear bearings are disposed on the bilateral sides of the second platform and between the first platform and the second platform.

According to the present invention, the three-link toggle type machine tool further comprises two second linear bearings penetrate a second slide rail respectively, wherein the two second linear bearings are disposed on the bilateral sides of the third platform and between the second platform and the third platform.

According to the present invention, the two first linear bearings are perpendicular to the first ballscrew.

According to the present invention, the two second linear bearings are perpendicular to the second ballscrew.

According to the present invention, the two opposite ends of the first linkage are connected to the first ballscrew and the second linkage by the ball bearing and the bolt.

According to the present invention, the two opposite ends of the second linkage are connected to the first linkage and the first base by ball the bearing and the bolt.

According to the present invention, the two opposite ends of the third linkage are connected to the second linkage and the second platform by the ball bearing and the bolt.

According to the present invention, the two opposite ends of the fourth linkage are connected to the second ballscrew and the fifth linkage by the ball bearing and the bolt.

According to the present invention, the two opposite ends of the sixth linkage are connected to the fifth linkage and the third platform by the ball bearing and the bolt.

BRIEF DESCRIPTION OF THE DRAWINGS

The invention will be described according to the appended drawings in which:

FIG. 7 is numerical analysis data of the first three-link toggle type positioning platform according to one embodiment of the present invention.

DETAILED DESCRIPTION OF THE INVENTION

The present invention provides a three-link toggle type positioning platform. For complete understanding of the present invention, the following description will describe in detail the method steps and the components. The present invention is not limited by the specified particulars of the radiation emitting semiconductor devices that are familiar to persons skilled in the art. In addition, well-known components or method steps are not described in detail so as to avoid any additional limitation. The preferable embodiments of the present invention are described in detail. In addition to the detailed descriptions, the present invention also can be applied to other embodiments. Therefore, the scope of the present invention is not limited, and is dependent on the following claims.

Figure 2:
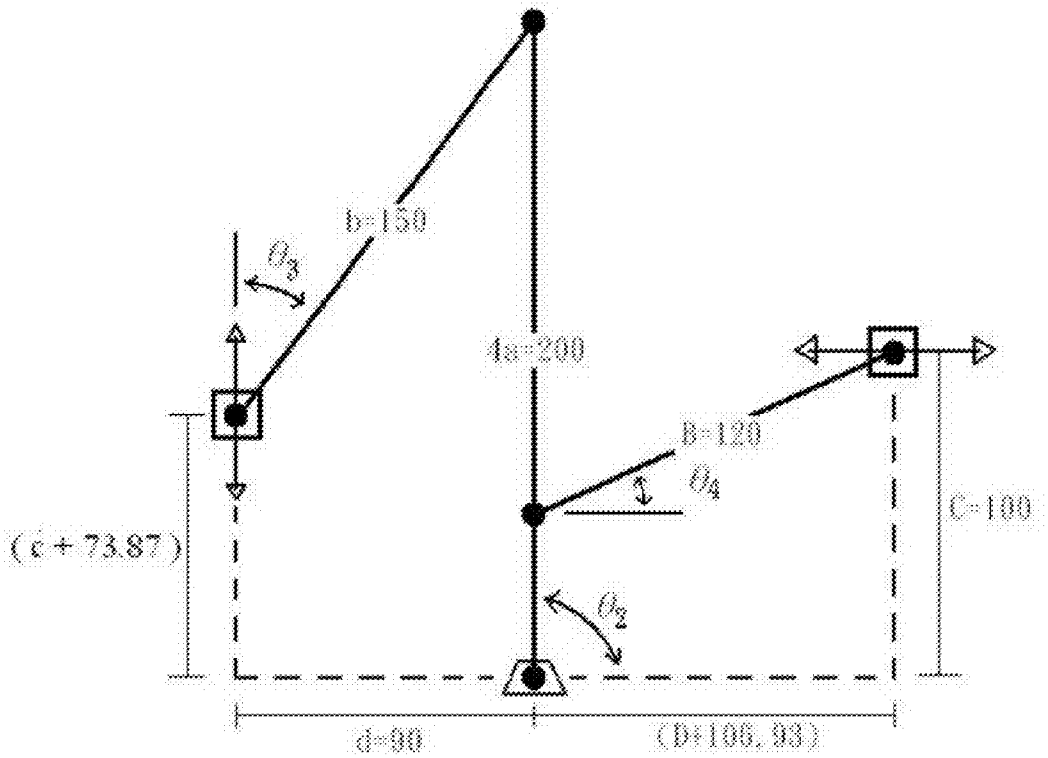
FIG. 2 shows a schematic diagram of a three-link structure.

The present invention is based on a three-link theorem which is shown by a schematic diagram of a three-link structure in FIG. 2. According to the diagram, we can substitute each angle and distance into two trigonometric equations below.

Input:

$$4a\times\sin(\theta_2)-b\times\cos(\theta_3)=73.87+c \quad (1)$$

$$b\times\sin(\theta_3)-4a\times\cos(\theta_2)=d \quad (2)$$

The expression in Equation (1) can be converted as:

$$\cos(\theta_3)=(4a\times\sin(\theta_2)-(c+73.87))/b$$

Then by applying Pythagorean Theorem, the above equation can be converted as:

$$b\times\sin(\theta_3)=(b2-(4a\times\sin(\theta_2)-c)^2)^{1/2}$$

By substituting the above equation into Equation (2), the following equation can be obtained.

$$(b2-(4a\times\sin(\theta_2)-c)^2)^{0.5}-4a\times\cos(\theta_2)-d=0 \quad (3)$$

Output:

$$a\times\sin(\theta_2)+B\times\cos(\theta_4)=C \quad (4)$$

$$a\times\cos(\theta_2)-B\times\cos(\theta_4)=D \quad (5)$$

The expression in Equation (4) can be converted as:

$$\sin(\theta_4)=(C-a\times\sin(\theta_2))/B$$

Then by applying Pythagorean Theorem, the above equation can be converted as:

$$B\times\cos(\theta_4)=(B2-(C-a\times\sin(\theta_2)^2)^{1/2})$$

By substituting the above equation into Equation (5), the following equation can be obtained.

$$a\times\cos(\theta_2)-(B2-(C-a\times\sin(\theta_2)^2)^{1/2})-(D+106.9445)=0 \quad (6)$$

where parameter a, b, c, d, B, C, $\theta_2$, $\theta_3$ and $\theta_4$ are clearly shown in FIG. 2, where a moving distance of platform D and a number of turns of motor c are unknown, and the following Equation (7) and (8) can be obtained by substituting the above parameters into Equation (3) and (6).

$$(22500-(200\times\sin(\theta_2)-(c+73.87))^2)^{0.5}-200\times\cos(\theta_2)-90=0 \quad (7)$$

$$(50\times\cos d(\theta_2)+(14400-(100-50\times\sin d(\theta_2))^2)^{0.5})-(D+106.93)=0 \quad (8)$$

Figure 1:
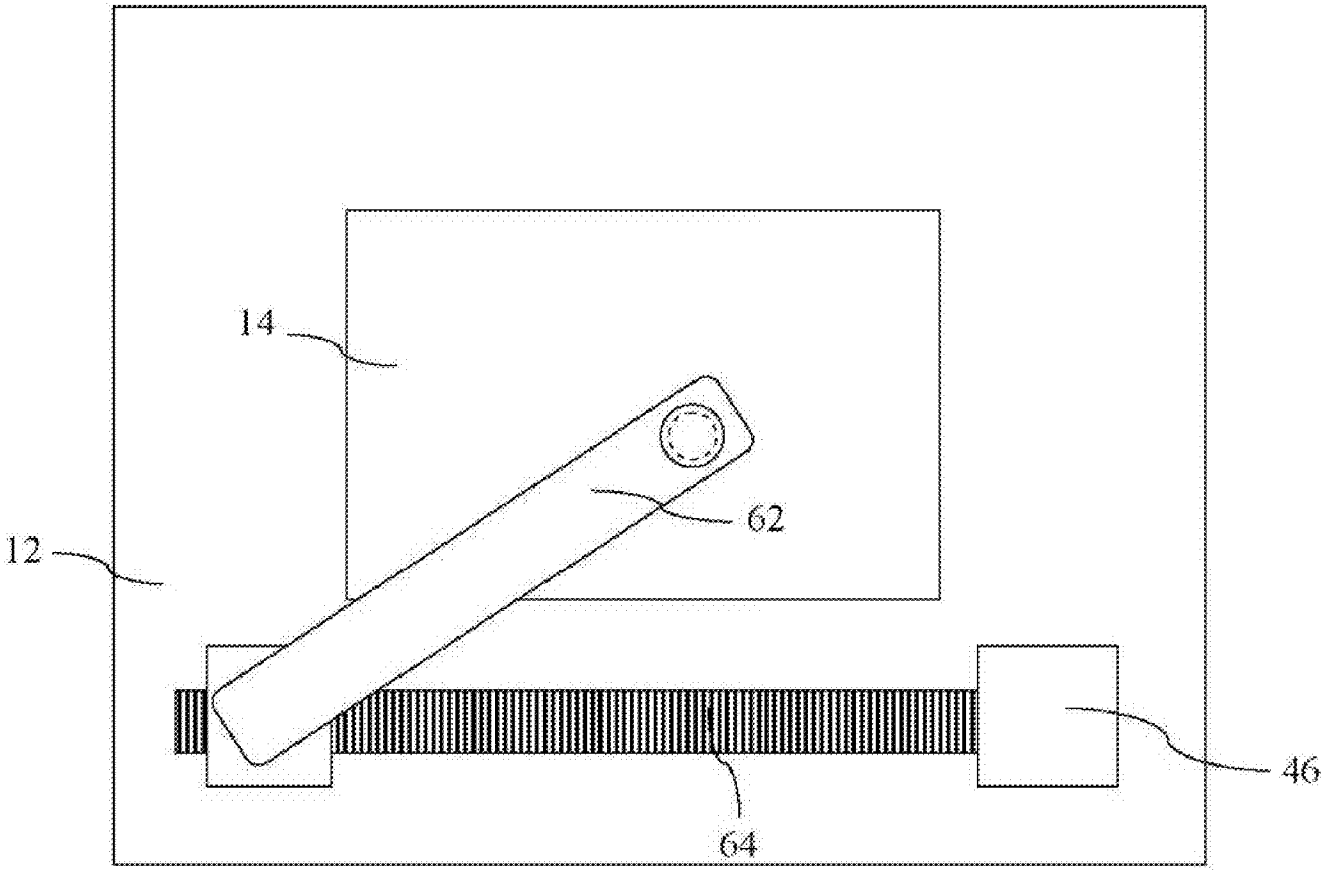
FIG. 1 shows a Taiwanese patent publication No. 302862 disclosing a toggle-type positioning platform.
Figure 3:
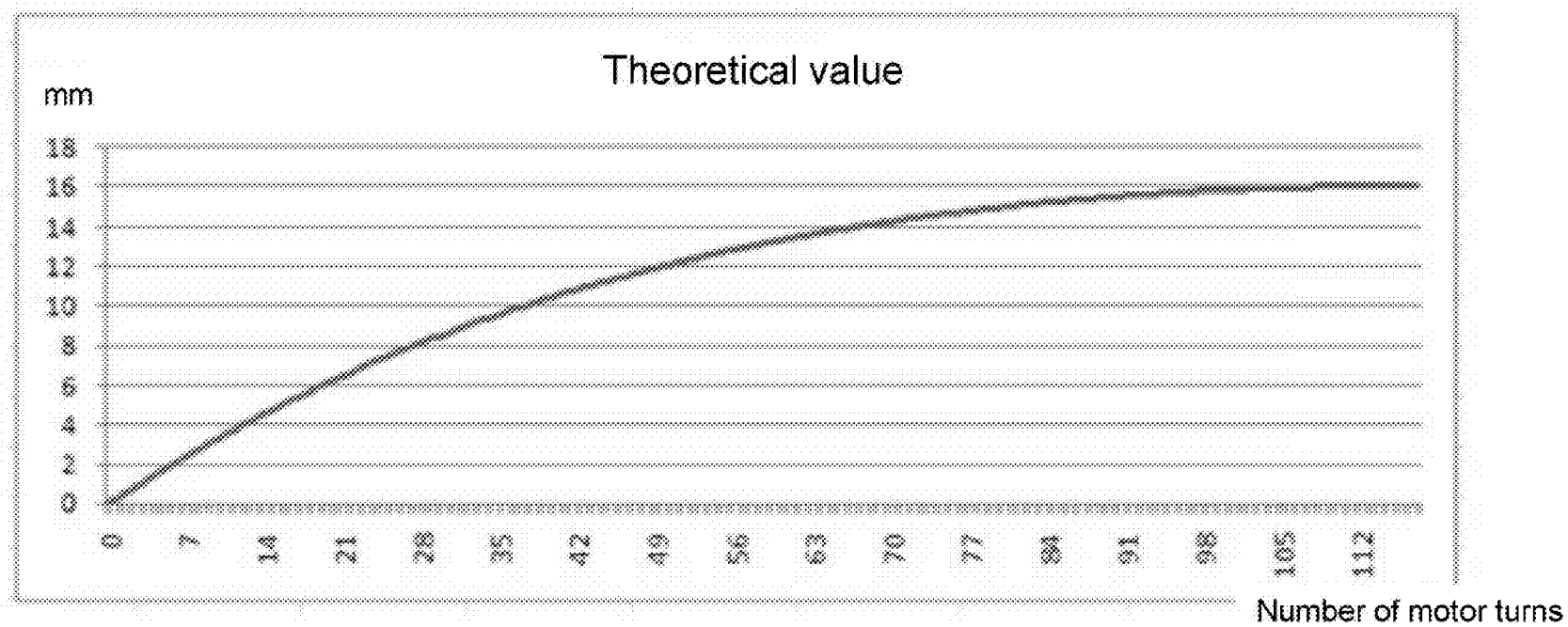
FIG. 3 is a theoretical curve diagram showing a relation between a number of turns of motor and a moving distance of platform.

Then utilizing a software called MATLAB to calculate Equation (7) and (8). Since the known angel $\theta_2$ is 90°, according to FIG. 1, the moving distance of platform D can be obtained by substituting the number of turns of motor c into Equation (7) and (8). FIG. 3 is a theoretical curve diagram showing a relation between the number of turns of motor and the moving distance of platform, wherein the number of turns of motor and the moving distance of platform are in direct proportion, that is to say, when the number of turns of motor increases, the moving distance of platform will increase, too. Further, a slope value of the theoretical curve is large in the beginning. However, when the motor reached 98 turns, the moving distance of platform is significantly slowing down, thereby decreasing the slope value of the theoretical curve. In other words, according to the theoretical value, the present invention not only increases the moving speed of the platform but also improves the precision thereof.

Figure 4:
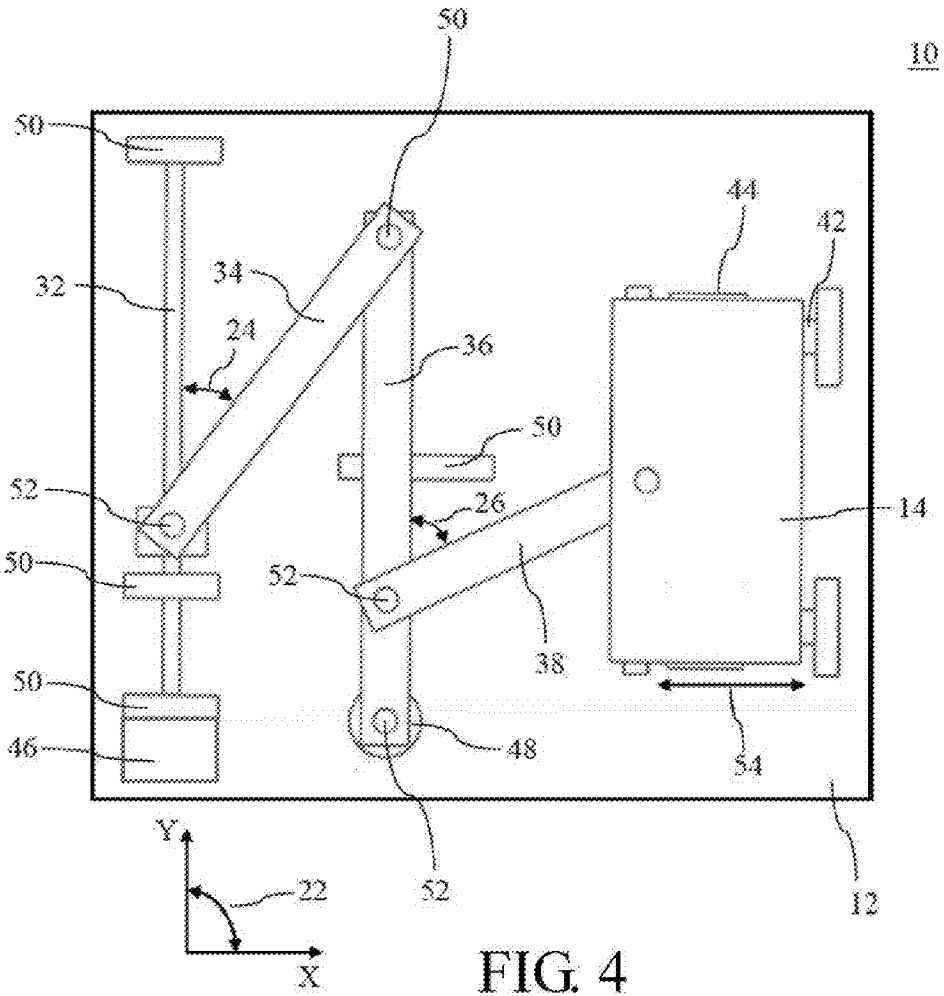
FIG. 4 shows a top view showing a three-link toggle type positioning platform of the present invention.

FIG. 4 is a top view showing a three-link toggle type positioning platform of the present invention. According to one embodiment, the present invention discloses a three-link toggle type positioning platform 10 which comprises a first platform 12, a first motor 46, a first ballscrew 32, a second platform 14, a first linkage 34, a second linkage 36 and a third linkage 38. The first motor 46 is disposed on the first platform 12. The first ballscrew 32 is disposed on the first platform 12 and coupled to the first motor 46, wherein the first motor 46 is suitable for driving the first ballscrew 32 to rotate. The second platform 14 is disposed on the first platform 12, wherein the second platform 14 is suitable for moving back and fourth alternately along a first predetermined path 54, wherein a first angle 22 is existed between an extended direction of the first predetermined path 54 and the first ballscrew 32. The second linkage 36 is fixed on a first base 48, and is parallel to the first ballscrew 32 and the second platform 14. The first linkage 34 is disposed between the first ballscrew 32 and the second linkage 36, wherein a second angle 24 existed between the first ballscrew 32 and the first linkage 34. The third linkage 38 is disposed between the second linkage 36 and the second platform 14, wherein a third angle 26 is existed between the second linkae 36 and the third linkage 38. Moreover, the first linkage 34, the second linkage 36 and the third linkage 38 are driven simultaneously by the rotation of the first ballscrew 32, such that the second platform 14 is driven to move along the first predetermined path 54.

Figure 5:
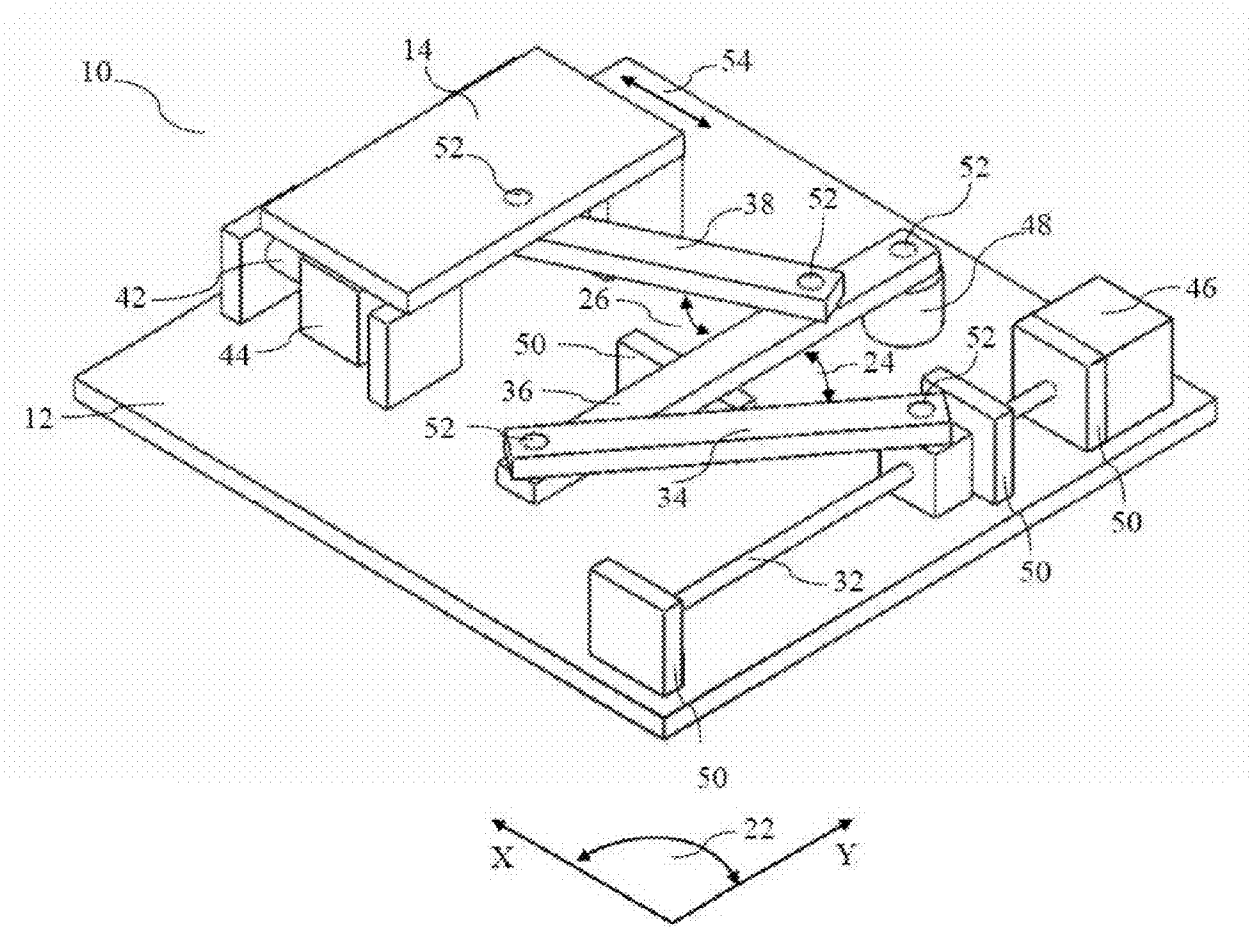
FIG. 5 shows a solid diagram of a three-link toggle type positioning platform according to the present invention.

Further, FIG. 5 shows a solid diagram of a three-link toggle type positioning platform according to the present invention. The aforesaid second platform 14 can move back and fourth along the first predetermined path 54 with the help of a first linear bearing 44 and a first slide rail 42. The present invention comprises a first linear bearing 44 penetrates a first slide rail 42, wherein two opposite ends of the first slide rail 42 are fixed on respective supporting frames 50. The length of the first slide rail 42 is equal to that of the first predetermined path 54. The moving direction of the first linear bearing 44 and the first slide rail 42 is perpendicular to the first ballscrew 32. Furthermore, the first linear bearing 44 and the first slide rail 42 are disposed between the first platform 12 and the second platform 14 and fixed on two opposite sides of the third platform 14. Due to the first linear bearing 44 is a long-shaped cylindrical tube, which is made of iron or other material, the second platform 14 can not being fixed on it. In the present embodiment, the first linear bearing 44 is fixed in a stable long-shaped quadrate tube in order to form a flat surface which disposed between the second platform 14 and the third platform 70 to avoid roatation. The second platform 14 may have a guide groove and the third platform 70 is suitable for moving along the guide groove. The guide groove has a cross-section of V-shape, U-shape, or other shapes. Besides, the present embodiment further comprises a ball bearing. The ball bearing is disposed on the second platform 14 and is between the second platform 14 and the third platform 70, and therefore the second platform 14 may move along the first predetermined path 54. In brief, the ball bearing may move along the guide groove (not shown).

The connecting structure for three-link linkage is to connect two opposite ends of the first linkage 34 with the first ballscrew 32 and the second linkage 36, and a second angle 24 is existed between the first ballscrew 32 and the fisrdt linkage 34. One opposite end of the second linkage 36 is fixed on the first base 48, wherein the first base 48 can support the second linkage 36. One end of the third linkage 38 connects to the second linkage 36 where near the first base 48. Moreover, one opposite end of the third linkage 38 connects the second platform, wherein a third angle 26 is existed between the second linkage 36 and the third linkage 38.

Due to one end of the second linkage 36 is connected to the first base 48 by a ball bearing and a bolt so as to function as a fixed axle, the second linkage 36 can only move left and right. When the first ballscrew 32 is driven by the first motor 46 to rotate, the first linkage 34, the second linkage 36 and the third linkage 38 are driven simultaneously by the first ballscrew 32 and cause the second angle 24 and the third angle 26 changing along with their movement. Since the second linkage 36 is fixed on the first base 48, the third linkage is non-movable. Moreover, in order to connect three linkages with the second base 14 and the first ballscrew 32 on a same horizontal plane, the three linkages have a supporting frame 50 which supports the three linkages having the same height as the second base 14 and the first ballscrew 32. In that way, the suspended three linkages can apply force properly.

Additionally, the second linkage 36 is connected to the first linkage 34 and the third linkage 38. When the first ballscrew 32 is driven by the first motor 46 to rotate, the three linkages are driven simultaneously by the rotation of the first ballscrew 32. The second angle 24 and the third angle 26 would change due to the movements of the three linkages, such that the second platform 14 is driven to move along the first predetermined path 54.

In the present invention, the first angle is existed between the extended directions of the second platform 14 and the first ballscrew 32, wherein the first angle is about 90°. The second angle is existed between the first linkage 34 and the third linkage 38, wherein the second angle is between about 0° to 90°. Further, the third angle is existed between the second linkage 36 and the third linkage 38, wherein the third angle is between about 0° to 90°.

The first ballscrew 32, the first linkage 34, the second linkage 36, the third linkage 38, the second platform 14 and the first base 48 are connected by the ball bearing and the bolt in order to decrease frictions therebetween and to decrease the load of the first motor 46.

Figure 6:
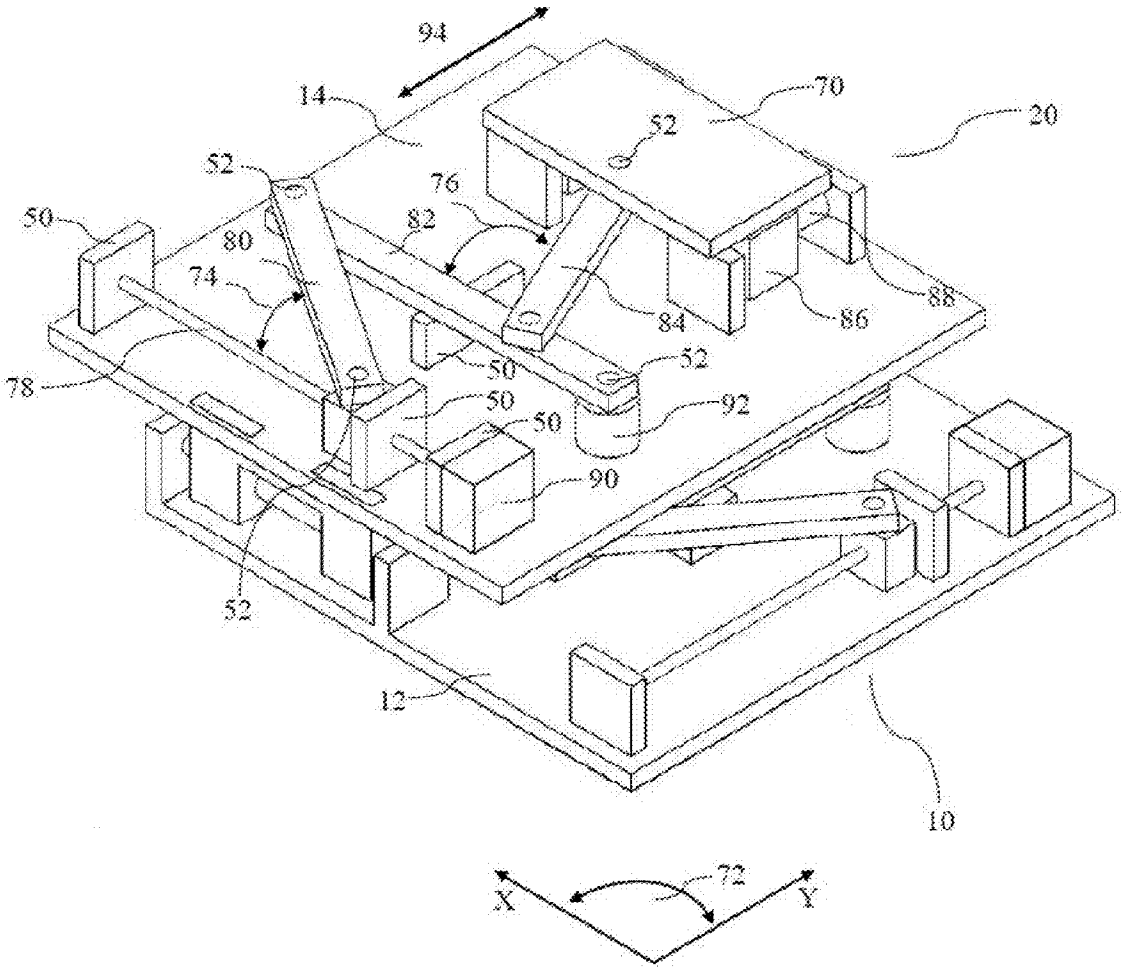
FIG. 6 shows a solid diagram of a three-link toggle type machine tool according to the present invention.

The present invention further provides a three-link toggle type machine tool, as shown in FIG. 6, which comprises a first three-link toggle type positioning platform 10 and a second three-link toggle type positioning platform 20, wherein the first three-link toggle type positioning platform 10 and the second three-link toggle type positioning platform 20 are stacked to form the three-link toggle type machine tool. In addition, a first predetermined path 54 of the first three-link toggle type positioning platform 10 is perpendicular to a second predetermined path 94 of the second three-link toggle type positioning platform 20.

Please refer to FIG. 5 since the detail structure of the first three-link toggle type positioning platform 10 does not show in FIG. 6. The first three-link toggle type positioning platform 10 comprises a first platform 12, a first motor 46, a first ballscrew 32, a second platform 14, a first linkage 34, a second linkage 36 and a third linkage 38. The first motor 46 is disposed on the first platform 12. The first ballscrew 32 is disposed on the first platform 12 and coupled to the first motor 46, wherein the first motor 46 is suitable for driving the first ballscrew 32 to rotate. The second platform 14 is disposed on the first platform 12, wherein the second platform 14 is suitable for moving back and fourth alternately along a first predetermined path 54, wherein a first angle 22 is existed between an extended direction of the first predetermined path 54 and the first ballscrew 32. The second linkage 36 is fixed on a first base 48 and is parallel to the first ballscrew 32 and the second platform 14. The first linkage 34 is disposed between the first ballscrew 32 and the second linkage 36, wherein a second angle 24 is existed between the first ballscrew 32 and the first linkage 34. The third linkage 38 is disposed between the second linkage 36 and the second platform 14, wherein a third angle 26 is existed between the second linkage 36 and the third linkage 38. Moreover, the first linkage 34, the second linkage 36 and the third linkage 38 are driven simultaneously by the rotation of the first ballscrew 32, such that the second platform 14 is driven to move along the first predetermined path 54.

Referring to FIG. 6, the second three-link toggle type positioning platform 20 is disposed on the first three-link toggle type positioning platform 10, wherein the second three-link toggle type positioning platform 20 comprises a second motor 90, a second ballscrew 78, a third platform 70, a fourth linkage 80, a fifth linkage 82, and a sixth linkage 84. The second motor 90 is disposed on the second platform 14. The second ballscrew 78 is disposed on the second platform 14 and coupled to a second motor 90, wherein the second motor 90 is suitable for driving the second ballscrew 78 to rotate. The third platform 70 is disposed on the second platform 14, wherein the third platform 70 is suitable for moving back and fourth alternately along a second predetermined path 94, wherein a fourth angle 72 is existed between an extended direction of the second predetermined path 94 and the second ballscrew 78. The fourth linkage 80 is disposed between the second ballscrew 78 and the fifth linkage 82, wherein a fifth angle 74 is existed between the second ballscrew 78 and the fourth linkage 80. The fifth linkage 82 is fixed on a second base 92 and is parallel to the second ballscrew 78 and the third platform 70. The sixth linkage 84 is disposed between the fifth linkage 82 and the third platform 70, wherein a sixth angle 76 is existed between the fifthlinkage 82 and the sixth linkage 84. Moreover, the fourth linkage 80, the fifth linkage 82 and the sixth linkage 84 are driven simultaneously by the rotation of the second ballscrew 78, such that the third platform 70 is driven to move along the second predetermined path 94.

The aforesaid third platform 70 can move back and fourth along the second predetermined path 94 with the help of a second linear bearing 88 and a second slide rail 86. The present invention comprises a second linear bearing 88 penetrates a second slide rail 86, wherein two opposite ends of the second slide rail 86 are fixed on repective supporting frames 50. The length of the second slide rail 86 is equal to that of the second predetermined path 94. The moving direction of the second linear bearing 88 and the second slide rail 86 is perpendicular to the second ballscrew 78 and the first predetermined path 54. Furthermore, the second linear bearing 88 and the second slide rail 86 are disposed between the second platform 14 and the third platform 70 and fixed on the bilateral sides of the third platform 70. Due to the second linear bearing 88 is a long-shaped cylindrical tube, which is made of iron or other materials, the third platform 70 can not being fixed on it. In the present embodiment, the second linear bearing 88 is fixed in a stable long-shaped quadrate tube in order to form a flat surface, which is disposed between the second platform 14 and the third platform 70 to avoid rotation. The second platform 14 may have a guide groove and the third platform 70 is suitable for moving along the guide groove. The guide groove has a cross-section of V-shape, U-shape, or other shapes. Besides, the present embodiment further comprises a ball bearing. The ball bearing is disposed on the second platform 14 and is between the second platform 14 and the third platform 70, and therefore the third platform 70 may move along the second predetermined path 94. In brief, the ball bearing may move along the guide groove (not shown).

The connecting structure for three-link linkage is to connect two opposite ends of the fourth linkage 80 with the second ballscrew 78 and the fifth linkage 82, wherein a fifth angle 74 is existed between the second ballscrew 78 and the fourth linkage 80. One opposite end of the fifth linkage 82 is fixed on the second base 92, wherein the second base 92 can support the fifth linkage 82. One end of the sixth linkage 84 connects to the fifth linkage 52 where near the second base 92. Moreover, one opposite end of the sixth linkage 84 connects the third platform 70, wherein a sixth angle 76 is existed between the fifth linkage 82 and the sixth linkage 84.

Due to one end of the fifth linkage 82 is connected to the second base 92 by a ball bearing and a bolt 52 so as to function as a fixed axle, the fifth linkage 82 can only move left and right. When the second ballscrew 78 is driven by the second motor 90 to rotate, the fourth linkage 80, the fifth linkage 82 and the sixth linkage 84 are driven simultaneously by the second ballscrew 78 and cause the fifth angle 74 and the sixth angle 76 changing along with their movement. Since the fifth linkage 82 is fixed on the second base 92, the third linkage is non-movable. Moreover, in order to connect three linkages with the third base 70 and the second ballscrew 78 on a same horizontal plane, the three linkages have a supporting frame 50 which supports the three linkages having the same height as the third base 70 and the second ballscrew 78. In that way, the suspended three linkages can apply force properly.

Additionally, the fifth linkage 82 is connected to the fourth linkage 80 and the sixth linkage 84. When the second ballscrew 78 is driven by the second motor 90 to rotate, the three linkages are driven simultaneously by the rotation of the second ballscrew 78. The fifth angle 74 and the sixth angle 76 would change due to the movements of the three linkages, such that the third platform 70 is driven to move along the second predetermined path 94.

In the present invention, the fourth angle is existed between the extended directions of the third platform 70 and the second ballscrew 78, wherein the fourth angle is about 90°. The fifth angle is existed between the fourth linkage 80 and the fifth linkage 82, wherein the fifth angle is between about 0° to 90°. Further, the sixth angle is existed between the fifth linkage 82 and the sixth linkage 84, wherein the sixth angle is between about 0° to 90°.

The second ballscrew 78, the fourth linkage 80, the fifth linkage 82, the sixth linkage 84, the third platform 70 and the second base 92 are connected by the ball bearing and the bolt 52 in order to decrease frictions therebetween and to decrease the load of the second motor 90.

Then, a LASER meter is being used to measure the amount of movement of the second platform 14 of the first three-link toggle type positioning platform 10. Placing a beam splitter in front of the LASER meter and a reflecting mirror on the second platform and then aligned for reflecting LASER beam. A measuring method is as follows. The beam splitter is used for splitting the LASER beam into a reference beam and a beam to be measured when it enters. The beam to be measured is then reflected back on the same path by the reflecting minor and meets the reference beam. After analyzed by a computer, the displacement of the second platform can be known.

FIG. 7 is numerical analysis data of the first three-link toggle type positioning platform according to one embodiment of the present invention, wherein the data is calculated by the measuring method described in the above paragraph.

Figure 8:
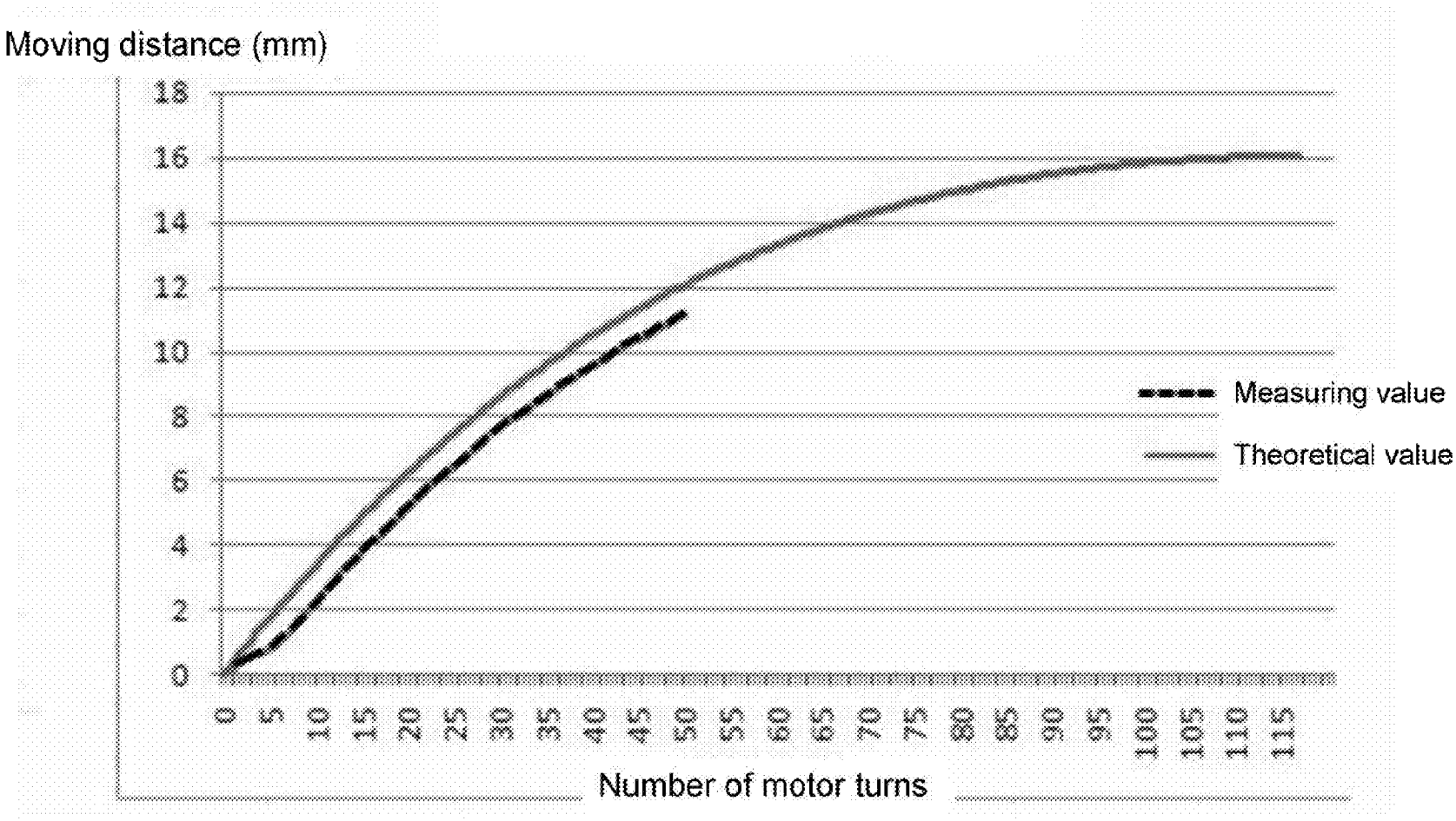
FIG. 8 is a curve diagram showing a relation between the theoretical value of a number of turns of motor and a moving distance of platform and that of the measuring value of a three-link toggle type positioning platform according to the present invention.

The relationship between number of turns of motor and amount of movement of platform can be calculated according to the data shown in FIG. 7 and being compared with theoretical value in FIG. 8. The maximum number of turns of motor in the present invention is only 50 turns less than that of the theory which has 100 turns. However, according to the data collected from 5 to 50 turns of the motor, the amount of movement of the second platform in one embodiment is very similar to theoretical value, that is, when the number of turns of motor in one embodiment of the present invention reaches 100 turns, the resulting value will be similar to theoretical value, too. Although the materials used in the present embodiment may have large effect to the experimental data, it is not under discussion here.

The present invention provides a positioning platform with a toggle-type mechanism to improve its positioning precision. Moreover, the present invention provides a positioning platform with a three-link toggle type mechanism which makes it move faster than a single-link toggle type mechanism The above-described embodiment of the present invention is intended to be illustrative only. Numerous alternative embodiments may be devised by persons skilled in the art without departing from the scope of the following claims.

What is claimed is:

1. A three-link toggle type positioning platform comprising:

a first platform;

a first motor on said first platform;

a first ballscrew, coupled to said first motor, wherein said first motor drives said first ballscrew to rotate;

a second platform, wherein said second platform moves back and forth alternately along a first predetermined path;

a first linkage with a first end and a second end, and said first end attached to said ballscrew, wherein said ballscrew drives said first linkage;

a first base on said first platform;

a second linkage with a third end and a fourth end, said third end attached to said second end of said first linkage, and said fourth end attached to said first base, wherein said first linkage drives said second linkage; and a third linkage with a fifth end and a sixth end, said fifth end attached to said second linkage, and said sixth end attached to said second platform, wherein said second linkage drives said third linkage and the third linkage drives said second platform moving along said first predetermined path wherein a first angle exists between said first ballscrew and an extended direction of said first predetermined path, a second angle exists between said first ballscrew and said first linkage, and a third angle exists between said second linkage and said third linkage.

2. The three-link toggle type positioning platform according to claim 1, wherein said first angle is about 0° to 90°.

3. The three-link toggle type positioning platform according to claim 1, wherein said second angle is between about 90°.

4. The three-link toggle type positioning platform according to claim 1, wherein said third angle is between about 0° to 90°.

5. The three-link toggle type positioning platform according to claim 1, wherein said three-link toggle type positioning platform comprises two first linear bearings separately penetrate a first slide rail, wherein said two first linear bearings disposed on two sides of said second platform, and disposed between said second platform and said first platform.

6. The three-link toggle type positioning platform according to claim 5, wherein said two first linear bearings are perpendicular to said first ballscrew.

7. The three-link toggle type positioning platform according to claim 1, wherein said first end and said second end of said first linkage are connected to said first ballscrew and said second linkage by a ball bearing and a bolt.

8. The three-link toggle type positioning platform according to claim 1, wherein said third end and said fourth end of said second linkage are connected to said first linkage and said first base by a ball bearing and a bolt.

9. The three-link toggle type positioning platform according to claim 1, wherein said fifth end and said sixth end of said third linkage connected to said second linkage and said second platform by ball bearing and bolt.

10. A three-link toggle type machine tool comprising:

a first three-link toggle type positioning platform comprising:

a first platform;

a first motor on said first platform;

a first ballscrew, coupled to said first motor, wherein said first motor drives said first ballscrew to rotate;

a second platform, wherein said second platform moves back and forth alternately along a first predetermined path;

a first linkage with a first end and a second end, and said first end attached to said ballscrew, wherein said ballscrew drives said first linkage;

a first base on said first platform;

a second linkage with a third end and a forth end, said third end attached to said second end of said first linkage, and said fourth end attached to said first base, wherein; said first linkage drives said second linkage and a third linkage with a fifth end and a sixth end, said fifth end attached to said second linkage, and said sixth end attached to said second platform, wherein said second linkage drives said third linkage, and the third linkage drives said second platform moving along said first predetermined path;

wherein a first angle exists between said first ballscrew and an extended direction of said first predetermined path, a second angle exists between said first ballscrew and said first linkage, and a third angle exists between said second linkage and said third linkage; and a second three-link toggle type positioning platform disposed on said first three-link toggle type positioning platform, said second three-link toggle type positioning platform comprising:

a second motor on said second platform;

a second ballscrew and coupled to a second motor, wherein said second motor drives said second ballscrew to rotate;

a third platform, wherein said third platform moves back and forth alternately along a second predetermined path;

a fourth linkage with a seventh end and a eighth end, and said seventh end attached to said second ballscrew, wherein said second ballscrew drives said fourth linkage;

a second base on said second platform;

a fifth linkage with a ninth end and a tenth end, said ninth end attached to said eighth end of said fourth linkage and said tenth end attached to said second base, wherein said fourth linkage drives said fifth linkage, and a sixth linkage with an eleventh end and a twelfth end, said eleventh end attached to said fifth linkage, said twelfth end attached to said third platform, wherein said fifth linkage drives said sixth linkage, and said sixth linkage drives said third platform moving along said second predetermined path;

wherein a fourth angle exists between said second ballscrew and an extended direction of said second predetermined path, a fifth angle exists between said second ballscrew and said fifth linkage, and a sixth angle exists between said fifth linkage and said sixth linkage.

11. The three-link toggle type machine tool according to claim 10, wherein said first angle is about 0° to 90°.

12. The three-link toggle type machine tool according to claim 10, wherein said second angle is between about 90°.

13. The three-link toggle type machine tool according to claim 10, wherein said third angle is between about 0° to 90°.

14. The three-link toggle type machine tool according to claim 10, wherein said fourth angle is about 0° to 90°.

15. The three-link toggle type machine tool according to claim 10, wherein said fifth angle is between about 90°.

16. The three-link toggle type machine tool according to claim 10, wherein said sixth angle is between about 0° to 90°.

17. The three-link toggle type machine tool according to claim 10, wherein said three-link toggle type machine tool comprises two first linear bearings separately penetrate a first slide rail, wherein said two first linear bearings disposed on two sides of said second platform, and disposed between said second platform and said first platform.

18. The three-link toggle type machine tool according to claim 10, wherein said three-link toggle type machine tool comprises two second linear bearings separately penetrate a second slide rail, wherein said two second linear bearings disposed on two sides of said third platform, and disposed between said third platform and said second platform.

19. The three-link toggle type machine tool according to claim 17, wherein said two first linear bearings are perpendicular to said first ballscrew.

20. The three-link toggle type machine tool according to claim 18, wherein said two second linear bearings are perpendicular to said second ballscrew.

21. The three-link toggle type machine tool according to claim 10, wherein said first end and said second end of said first linkage are connected to said first ballscrew and said second linkage by a ball bearing and a bolt.

22. The three-link toggle type machine tool according to claim 10, wherein said third end and said fourth end of said second linkage are connected to said first linkage and said first base by ball a bearing and a bolt.

23. The three-link toggle type machine tool according to claim 10, wherein said fifth end and said sixth end of said third linkage are connected to said second linkage and said second platform by a ball bearing and a bolt.

24. The three-link toggle type machine tool according to claim 10, wherein said seventh end and said eighth end of said fourth linkage are connected to said second ballscrew and said fifth linkage by a ball bearing and a bolt.

25. The three-link toggle type machine tool according to claim 10, wherein said ninth end and said tenth end of said fifth linkage are connected to said fourth linkage and said second base by a ball bearing and a bolt.

26. The three-link toggle type machine tool according to claim 10, wherein said eleventh end and said twelfth end of said sixth linkage are connected to said fifth linkage and said third platform by a ball bearing and a bolt.

* * * * *